US009101042B2

(12) United States Patent
Voronin et al.

(10) Patent No.: US 9,101,042 B2
(45) Date of Patent: Aug. 4, 2015

(54) CONTROL OF UNIFORMITY IN A SURFACE WAVE PLASMA SOURCE

(71) Applicant: Tokyo Electron Limited, Tokyo (JP)

(72) Inventors: Sergey A. Voronin, Rensselaer, NY (US); Alok Ranjan, Slingerlands, NY (US)

(73) Assignee: Tokyo Electron Limited, Tokyo (JP)

( * ) Notice: Subject to any disclaimer, the term of this patent is extended or adjusted under 35 U.S.C. 154(b) by 338 days.

(21) Appl. No.: 13/720,485

(22) Filed: Dec. 19, 2012

(65) Prior Publication Data

US 2014/0028184 A1 Jan. 30, 2014

Related U.S. Application Data

(60) Provisional application No. 61/674,941, filed on Jul. 24, 2012.

(51) Int. Cl.
*H01Q 1/26* (2006.01)
*H05H 1/46* (2006.01)

(52) U.S. Cl.
CPC ..... *H05H 1/46* (2013.01); *H05H 2001/463* (2013.01); *H05H 2001/4615* (2013.01)

(58) Field of Classification Search
CPC ..... H01J 37/32192; H01J 37/3222; H01J 37/32229; H01J 37/32211; H01J 37/32623; H01J 37/32266; H01J 37/321; H05H 1/46; H05H 2001/463; H05H 2001/4615; H05H 1/24; H05H 1/0062; H05H 2001/4622
USPC ..... 315/34–39, 111.21, 111.41
See application file for complete search history.

(56) References Cited

U.S. PATENT DOCUMENTS

| | | | | |
|---|---|---|---|---|
| 7,138,767 | B2 | 11/2006 | Chen et al. | |
| 7,396,431 | B2 | 7/2008 | Chen et al. | |
| 7,584,714 | B2 | 9/2009 | Chen et al. | |
| 7,938,081 | B2 | 5/2011 | Chen et al. | |
| 7,998,307 | B2 | 8/2011 | Chen et al. | |
| 8,415,884 | B2 | 4/2013 | Chen et al. | |
| 8,669,705 | B2 | 3/2014 | Chen et al. | |
| 8,877,080 | B2 | 11/2014 | Chen et al. | |
| 2011/0057562 | A1* | 3/2011 | Chen et al. | 315/39 |
| 2013/0084706 | A1 | 4/2013 | Zhao et al. | |
| 2013/0270997 | A1 | 10/2013 | Zhao et al. | |
| 2014/0028184 | A1 | 1/2014 | Voronin et al. | |
| 2014/0028190 | A1 | 1/2014 | Voronin et al. | |
| 2014/0315347 | A1 | 10/2014 | Ruzic et al. | |

* cited by examiner

*Primary Examiner* — Lincoln Donovan
*Assistant Examiner* — Diana J Cheng
(74) *Attorney, Agent, or Firm* — Wood, Herron & Evan, LLP

(57) ABSTRACT

A surface wave plasma source (SWPS) is disclosed, having an electromagnetic (EM) wave launcher including a slot antenna configured to couple EM energy in a desired EM wave mode to a plasma by generating a surface wave on a plasma surface of the SWPS adjacent the plasma. The SWPS also includes a dielectric window positioned below the slot antenna, having a lower surface and the plasma surface. The SWPS further includes an attenuation assembly disposed between the slot antenna and the plasma surface. The attenuation assembly includes a first fluid channel substantially aligned with a first arrangement of slots in the slot antenna, and is configured to receive a first flow of a first fluid at a first fluid temperature. The SWPS finally includes a power coupling system coupled to the EM wave launcher and configured to provide EM energy to the EM wave launcher for forming the plasma.

20 Claims, 3 Drawing Sheets

CONTROL OF UNIFORMITY IN A SURFACE WAVE PLASMA SOURCE

CROSS REFERENCE TO RELATED APPLICATION

Pursuant to 37 C.F.R. §1.78(a)(4), this application claims the benefit of and priority to prior filed Provisional Application Ser. No. 61/674,941, filed Jul. 24, 2012, which is expressly incorporated herein by reference.

FIELD OF THE INVENTION

This invention relates to semiconductor processing technology. Specifically, the invention relates to apparatus and methods for controlling properties of a surface wave plasma source.

BACKGROUND OF THE INVENTION

Typically, during semiconductor processing, a (dry) plasma etch process is used to remove or etch material along fine lines or within vias or contacts patterned on a semiconductor substrate. The plasma etch process generally involves positioning a semiconductor substrate with an overlying patterned, protective layer, for example a photoresist layer, into a processing chamber.

Once the substrate is positioned within the chamber, it is etched by introducing an ionizable, dissociative gas mixture into the chamber at a pre-specified flow rate, while adjusting a vacuum pump to achieve a processing pressure. Then, plasma is formed when a portion of the gas species is ionized by collisions with energetic electrons. The heated electrons dissociate some of the gas species in the gas mixture to create reactant species suitable for the exposed surface-etch chemistry. Once the plasma is formed, any exposed surfaces of the substrate are etched by the plasma at a rate that varies as a function of plasma density, average electron energy, and other factors.

Conventionally, various techniques have been implemented for exciting a gas into plasma for the treatment of a substrate during semiconductor device fabrication, as described above. In particular, ("parallel plate") capacitively coupled plasma (CCP) processing systems, or inductively coupled plasma (ICP) processing systems have been used commonly for plasma excitation. Among other or more specific types of plasma sources, there are microwave plasma sources (including those using electron-cyclotron resonance (ECR)), surface wave plasma (SWP) sources, and helicon plasma sources.

It is becoming common wisdom that SWP sources, which include a slot antenna, offer improved plasma processing performance, particularly for etching processes, over CCP systems, ICP systems and resonantly heated systems. SWP sources produce a high degree of ionization at a relatively lower Boltzmann electron temperature ($T_e$) near the processing target (substrate). In addition, SWP sources generally produce plasma richer in electronically excited molecular species with reduced molecular dissociation. However, the practical implementation of SWP sources still suffers from several deficiencies including, for example, plasma stability and uniformity.

For a number of reasons, including charged ions and electrons recombining on chamber walls as they propagate from the source to the substrate, plasma density is often substantially non-uniform near the substrate. For ICP or CCP systems, such plasma density irregularity may be reduced by injecting a fraction of the process gasses into a region near the top of the chamber, and the balance of the gas through a ring near the substrate. This technique is somewhat effective when the electron temperature is sufficiently high to yield effective ionization and plasma-chemical reactions near the gas ring. However, since the average electron temperature in a SWP source that uses a slot antenna is relatively low, only molecules with weak chemical bonds can be cracked effectively near the gas ring. This limits spatial control of the plasma chemistry near the wafer and, therefore impacts the system application range. Therefore, an effective means to control the process plasma density in a surface wave plasma etch system with a slot antenna is needed.

SUMMARY OF THE INVENTION

The present invention provides a surface wave plasma source (SWPS), including an electromagnetic (EM) wave launcher configured to couple EM energy in a desired EM wave mode to a plasma by generating a surface wave on a plasma surface located adjacent the plasma. The EM wave launcher includes a slot antenna having a plurality of slots formed therethrough configured to couple the EM energy from a first region above the slot antenna to a second region below the slot antenna. The SWPS also includes a dielectric window positioned in the second region and having a lower surface of the dielectric window including the plasma surface. The SWPS further includes an attenuation assembly that has a first fluid channel formed within the attenuation assembly. The first fluid channel is substantially aligned with a first arrangement of slots in the plurality of slots, and is configured to receive a first flow of a first fluid at a first fluid temperature. Finally, a power coupling system is coupled to the EM wave launcher and configured to provide the EM energy to the EM wave launcher for forming the plasma.

A method for controlling plasma properties in a surface wave plasma source (SWPS) is also provided. The method starts with providing an electromagnetic (EM) wave launcher configured to couple EM energy in a desired EM wave mode to a plasma by generating a surface wave on a plasma surface located adjacent the plasma. The EM wave launcher includes a slot antenna having a plurality of slots formed therethrough configured to couple the EM energy from a first region above the slot antenna to a second region below the slot antenna. The method further includes positioning a dielectric window in the second region having a lower surface of the dielectric window including the plasma surface. An attenuation assembly is disposed between the slot antenna and the plasma surface, wherein the attenuation assembly includes a first fluid channel substantially aligned with a first arrangement of slots in the plurality of slots and configured to receive a first flow of a first fluid at a first fluid temperature. The method also includes coupling a power coupling system to the EM wave launcher that is configured to provide the EM energy to the EM wave launcher for forming the plasma. The method finally includes controlling a plasma property of the plasma by adjusting a dielectric property, namely the first fluid temperature, of the attenuation assembly.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

For more efficient control over plasma density distribution in a processing chamber, the present invention adjusts the microwave power emission from at least one region of slots in a slot antenna assembly of a surface wave plasma source ("SWPS").

One of ordinary skill in the art will recognize that the dielectric properties of many liquids change as a function of their temperature. Consequently, the microwave ("MW") penetration depth ("$D_p$") into a liquid can be controlled by changing the temperature of the liquid. The penetration depth $D_p$ can be expressed by the following formula:

$$D_p = \frac{\lambda_0}{2\pi\sqrt{(2\varepsilon')}} \frac{1}{\sqrt{\left[\left\{1+\left(\frac{\varepsilon''}{\varepsilon'}\right)^2\right\}^{0.5}-1\right]}}$$

wherein $\in'$ is the relative dielectric constant, $\in''$ is relative dielectric loss or energy dissipation ($\in''$ values are higher at lower temperatures), and $\lambda_0$ is the free space wavelength of the microwave radiation (12.2 cm for 2.45 GHz).

For example, MW penetration depth $D_p$ in distilled water at 2.45 GHz varies between 1.3 cm and 5 cm when the temperature of the distilled water changes from 25° C. to 85° C. As the following description will show in detail, the disclosed invention takes advantage of this property to attenuate EM emissions at certain regions of the slot antenna, while allowing other regions to transmit EM signals with minimum attenuation. This serves to improve the uniformity of the resulting plasma distribution in the processing chamber. In the description that follows, even though references may be made to microwaves or other enumerated bands of electromagnetic emissions, it should be understood that the system and method apply to a wide variety of desired electromagnetic wave modes (waves of a chosen frequency, amplitude, and phase).

Figure 1:
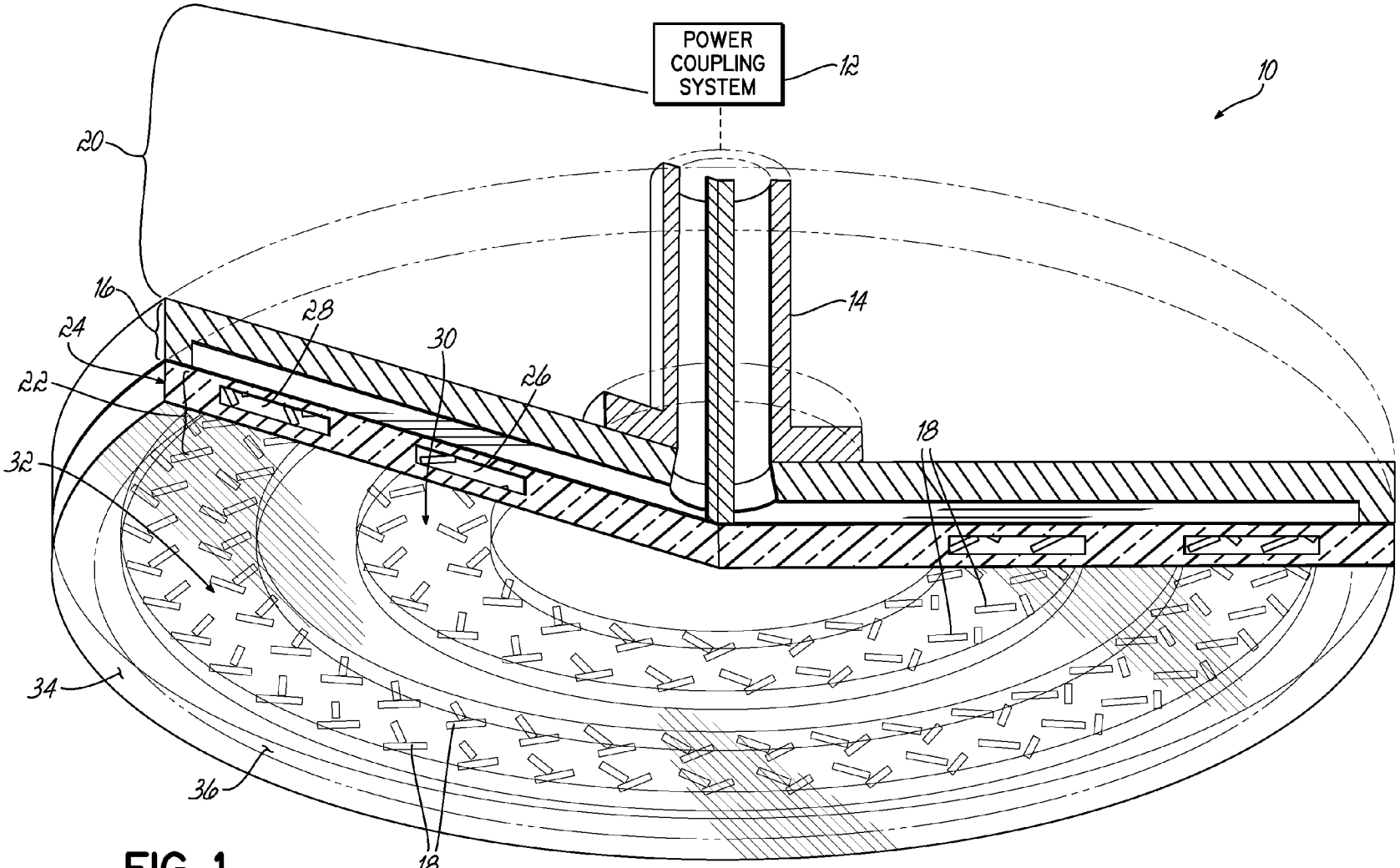
FIG. 1 is a cross-sectional perspective view of an embodiment of the invention.

FIG. 1 depicts a cross-sectional view of an SWPS 10. A power coupling system 12 provides input EM energy into a wave guide 14, which is depicted as a coaxial wave guide 14. Below the coaxial wave guide 14, is a slot antenna 16 including a plurality of slots 18 formed therethrough, where the slot antenna is depicted as a radial line slot antenna ("RLSA"). In the description that follows, the slot antenna 16 and slots 18 may be collectively referred to as an EM wave launcher. When energized, the power coupling system 12 generates EM energy in a first region 20 above the slot antenna 16, which passes through the slots 18 into a second region 22 below the slot antenna 16. A dielectric window 24 is situated in the second region 22 below the slot antenna 16. As indicated above, the slot antenna 16 and wave guide 14 are depicted and described herein as an RLSA and coaxial wave guide, respectively. However, it may be appreciated that other types of slot antennas and wave guides may be used in an SWPS 10 of the invention, for example, depending on the geometry of other components in the system, such as the substrate to be processed The dielectric window 24 includes a plurality of fluid channels, shown here as a first fluid channel 26 and a second fluid channel 28. The first fluid channel 26 and second fluid channel 28 are substantially aligned with a first arrangement of slots 30 and a second arrangement of slots 32 of the slot antenna 16, respectively. The dielectric window 24 has a lower surface 34 defining the entire planar area of the bottom face of the dielectric window 24, and a plasma surface 36 defining at least a portion of the area of the lower surface 34. In certain embodiments, the surface area of the plasma surface 36 is equal to the surface area of the lower surface 34. The plasma surface 36 is the area subjected to contact with generated plasma when in use. The dielectric window 24 may be mated with a wall of a semiconductor processing chamber, to provide a hermetic seal for the chamber, and a portal for transmission of EM waves into the chamber.

While in this particular embodiment the first fluid channel 26 and second fluid channel 28 are located within the structure of the dielectric window 24, other configurations may be used. When discussing a generic structure that includes at least a first fluid channel 26, it will be referred to as an attenuation assembly. As will be discussed in detail below, the attenuation assembly is configured to variably control the attenuation of EM waves by passing EM waves through a temperature-controlled fluid that is constrained by at least a fluid channel 26. To effectively provide variable attenuation, the attenuation assembly may be located anywhere between the slot antenna 16 and the plasma surface 36. In one embodiment, the attenuation assembly may be comprised of any material that is substantially transparent to EM waves. In another embodiment, the attenuation assembly may be fabricated as a non-monolithic or non-homogeneous structure, wherein some degree of attenuation is provided by the material properties of the attenuation assembly, and wherein additional variable attenuation is provided by passing a temperature-controlled fluid through at least one first fluid channel 26. As will be described in greater detail below, the attenuation assembly may be fabricated using a variety of techniques, to include joining a plurality of components with sealing members or o-rings, or by using a plastic pipe or duct to convey fluid.

Figure 2:
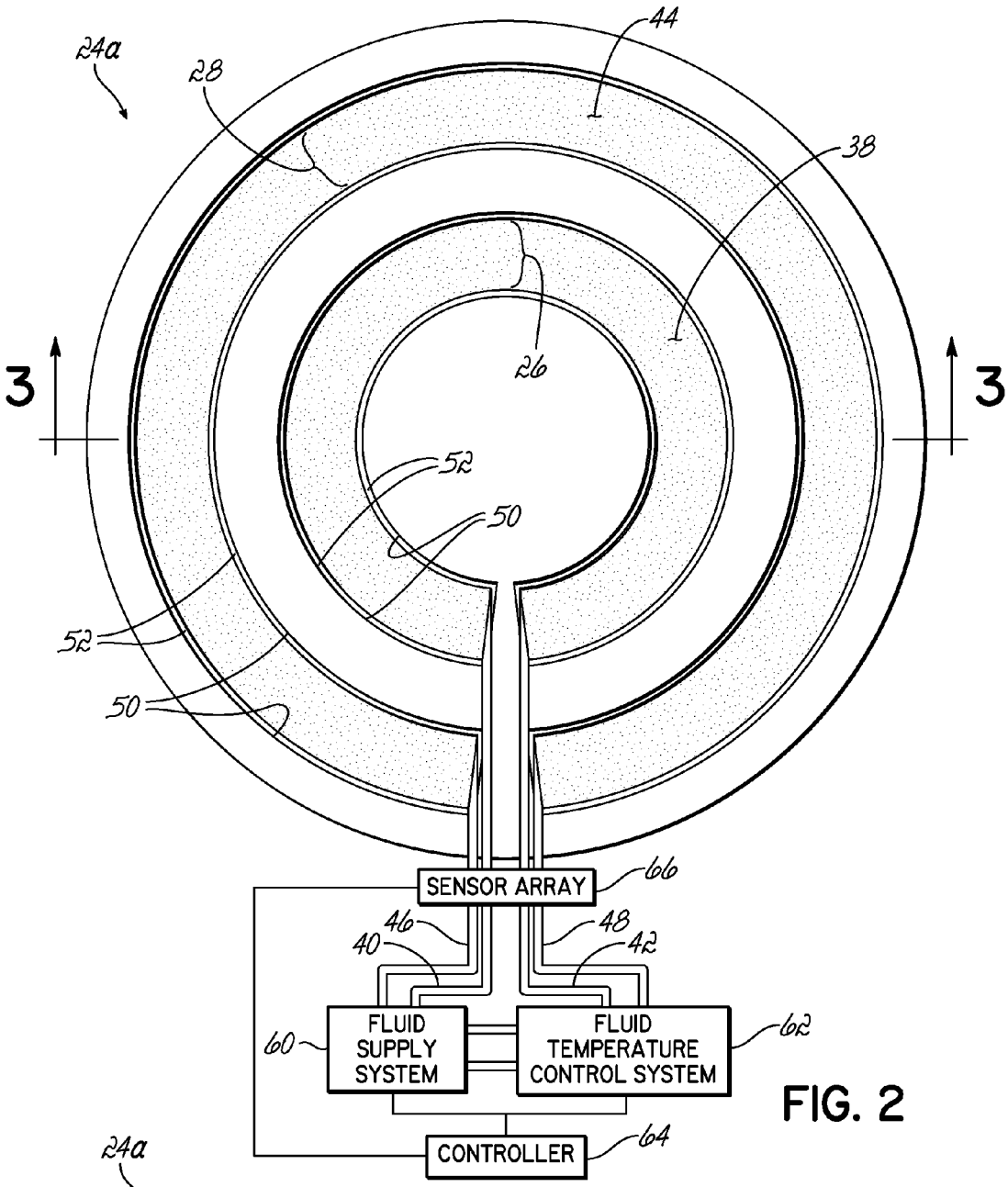
FIG. 2 is a top view of an attenuating element of an embodiment of the invention.

Referring to FIG. 2, in which like reference numerals are used to refer to like parts, detailed features of one embodiment of a dielectric window **24*a* are shown. A first fluid channel 26 and second fluid channel 28 are shown as being generally concentric to each other. When the dielectric window 24*a* is aligned with the slot antenna 16, the first fluid channel 26 substantially aligns with the first arrangement of slots 30, and the second fluid channel 28 is substantially aligned with the second arrangement of slots 32. A first inlet 40 and a second inlet 46, as well as their respective first outlet 42 and a second outlet 48, are fluidically coupled to the first fluid channel 26 and second fluid channel 28, respectively. The first inlet 40 and first outlet 42 pass through a side of the dielectric window 24*a*, and terminate exterior to the dielectric window 24*a*. Likewise, the second inlet 46 and second outlet 48 pass through a side of the dielectric window 24*a*, and terminate exterior to the dielectric window 24*a*. In use, a first fluid 38 is injected into the first fluid channel 26 by way of the first inlet 40, and recovered by use of the first outlet 42. Likewise a second fluid 44 may be injected into the second fluid channel 28 by way of the second inlet 46, and recovered by use of the second outlet 48. A sealing channel 50 and sealing member 52, configured to establish the first fluid channel 26 and second fluid channel 28**, will be explored in detail below.

A fluid supply system 60 and a fluid temperature control system 62 may be fluidically coupled to the first fluid channel 26 by way of the first inlet 40 and the first outlet 42. Similarly, the fluid supply system 60 and a fluid temperature control system 62 may be fluidically coupled to the second fluid channel 28 by way of the second inlet 46, and the second outlet 48. The fluid supply system may include reservoirs and pumps configured to supply a flow of the first fluid 38 into the first inlet 40, through the first fluid channel 26, and out of the first outlet 42 at a first flow rate. The pump may be fixed speed, multi-speed, or variable speed. In one embodiment, the first fluid 38 is circulated at a first flow rate of a few liters per minute. By way of example and not limitation, when using deionized water, a first flow rate of about 5 liters per minute to about 20 liters per minute may be used. In an embodiment of the invention, a flow rate of 11 liters per minute is used. A fluid temperature control system 62 may be disposed in series with the fluid supply system 60, and is configured to control the first fluid 38 at a first fluid temperature. In most operating environments, given the heat generated by the plasma generation, the fluid temperature control system 62 would be configured to reduce the temperature of the first fluid 38 leaving the first outlet 42 prior to being reintroduced to the first inlet 40 by the fluid supply system 60. The fluid temperature control system 62 may use evaporative cooling chillers, air cooled chillers, heat exchange with a remote heat-sink of lower energy, or other methods of heat transfer known to one of ordinary skill in the art. While some embodiments of the fluid temperature control system 62 may include only heat removal means, other embodiments may also include heat introduction means. For example, the fluid temperature control system may include a resistive heating element, vapor condensation heat pump, heat exchange with a remote heat-sink of higher energy, or the like. The same configuration variations and methods of operation apply to the second fluid channel 28 or additional channels.

A controller 64 may be operably coupled to the fluid supply system 60 and the fluid temperature control system 62, and may be configured to adjust a first dielectric property of the dielectric window 24*a* proximate the first arrangement of slots 30. The controller 64 may provide independent and simultaneous power control from the first arrangement of slots 30, the second arrangement of slots 32, or additional arrangements of slots 18 of the slot antenna 16, by screening or attenuating regions of the EM emissions. The first dielectric property of the dielectric window 24*a* is adjusted by manipulating the first heat and first flow rate of the first fluid 38, and thereby attenuating the emitted EM energy by a desired amount. The system 10 may also include a sensor array electrically coupled to the controller 64, and fluidically coupled to the first inlet 40, first outlet 42, second inlet 46, and second outlet 48. The sensor array 66 may contain elements configured to sense temperature, flow, pressure, viscosity, or other operating characteristics (metrics) of the first fluid 38. The same method of operation applies to the second fluid channel 28 or additional channels.

As would be apparent to one of ordinary skill in the art, the number of fluid channels may be increased to provide a higher degree of dielectric variability throughout different regions of the dielectric window 24*a*, or they may be reduced for enhanced simplicity and economy. Likewise, the SWPS 10 may employ a plurality of fluid supply systems 60 and a plurality of fluid temperature control systems 62. Conversely, the SWPS 10 may utilize a single fluid supply system 60 and a single fluid temperature control system 62, each configured to interface with a plurality of fluid channels.

Figure 3:
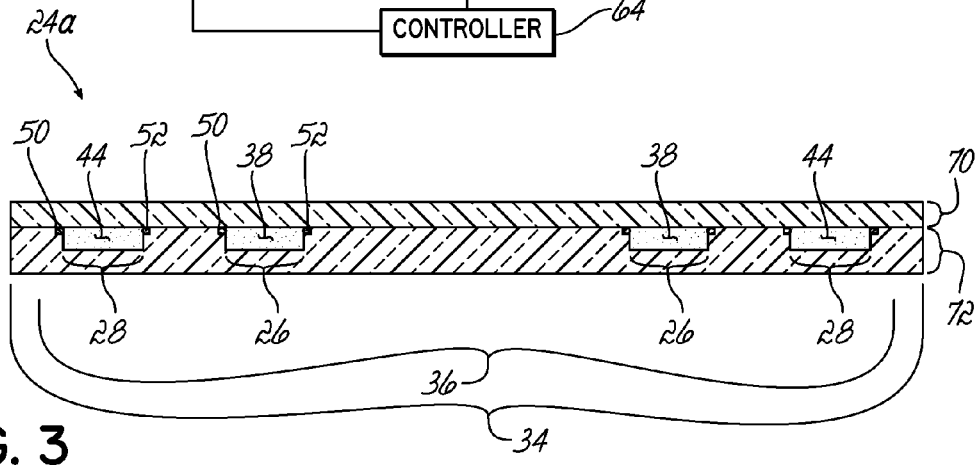
FIG. 3 is a side cross-sectional view taken along line 3-3 of FIG. 2.

Referring now to FIG. 3, a cross-sectional view of the dielectric window 24*a*, taken along line 3-3 of FIG. 2, is shown to illustrate one possible configuration of the first fluid channel 26 and second fluid channel 28. The dielectric window 24*a* is fabricated by mating a first portion 70 and a second portion 72 of generally equal surface area dimensions. In this example, the first portion 70 is a substantially flat sheet of quartz. The first fluid channel 26, second fluid channel 28, and sealing channel 50 are physically machined into a face of the second portion 72. A sealing member 52 (e.g., o-ring, RTV silicone, urethane, etc.) is placed into the sealing channel 50, and dimensioned such that the sealing member 52 protrudes past the exterior of the second portion 72. The first portion 70 and second portion 72 are brought into contact with each other to establish a complete dielectric window 24*a* with integral channels. In lieu of utilizing a sealing channel 50 and sealing member 52, a sufficiently EM-transparent pipe or duct may be deposited into the negative features of the second portion 72. The pipe or duct is configured to form a fluid-tight barrier between the fluid channel 26, 28 and its respective fluid. The pipe or duct thus obviates the need for additional sealing features, and the first portion 70 may be omitted. Alternatively, the first portion 70 may still be mated with the second portion 72 to envelop and protect the pipe or duct.

In use, the SWPS 10 may be coupled to the top of a semiconductor processing chamber, and energized to establish an improved uniformity plasma adjacent the plasma surface 36 and within the semiconductor processing chamber. As the power coupling system 12 is energized, EM waves pass down through the coaxial waveguide 14 and propagate through the slots 18 of the slot antenna 16, from a first region 20 above slot antenna 16, to a second region 22, below the slot antenna 16. In this described embodiment, the attenuation assembly is the dielectric window 24, but as described above, other structures may be disposed between the slot antenna 16 and the plasma surface 36. While a plurality of fluid channels may be utilized, this example will discuss only the first fluid channel 26, and its related features. The same operating concepts apply to a plurality of fluid channels.

The first fluid 38 is pumped into the first inlet 40 by the fluid supply system 60. The first fluid 38 passes through the first fluid channel 26 and exits through the first outlet 42 where it is recovered by the pumping system 60. A fluid temperature control system 62 is disposed in series with the pumping 60 system. The fluid temperature control system 62 is configured to adjust the first fluid temperature, and may do so by processing the first fluid 38 as it leaves the first outlet 42, or prior to entering the first inlet 40.

The EM wave energy and operating environment will result in heat transfer between the dielectric window 24 and the first fluid 38. Therefore, the system 10 must be adjusted to maintain desired operating characteristics. At least two variables (collectively referred to as fluid metrics) may be adjusted to produce desired plasma processing characteristics. The at least two fluid metrics include the average magnitude of the fluid temperature and the speed of the first flow rate.

As to the first metric, since a selected first temperature must be maintained to produce a desired level (or percentage) of attenuation, the system 10 must maintain a selected first fluid temperature. However, because the first fluid 38 will adsorb heat while the system 10 is operating, temperature throughout the first fluid 28 is not constant throughout its volume. Therefore, the system 10 must make adjustments to maintain a desired average first fluid temperature. This may require the fluid temperature control system 62 to provide the first fluid 38 to the first inlet 40 at a temperature that is initially below the selected average first fluid temperature. This is because the first fluid 38 will adsorb heat as it travels through the first fluid channel 26.

With regard to the second metric, the first fluid temperature at the first outlet 42 will often be higher than the first fluid temperature that the first inlet 40. Even if a desired average first fluid temperature is ultimately achieved, a large temperature differential between the first fluid temperature at the first inlet 40 and at the first outlet 42 will produce non-uniform attenuation over the area of the first fluid channel 26. Therefore, the temperature differential must also be controlled.

Generally, higher rates of flow advantageously result in lower heat adsorption. This yields a decreased temperature differential of the first fluid 38 at the first inlet 40 when compared with and first outlet 42. This also reduces stress and loading of the fluid temperature control system 62. In one embodiment, a first flow rate may be a few liters per minute.

A desired attenuation percentage and uniformity may be obtained by maintaining a selected average first fluid temperature within the first fluid channel 26, in conjunction with maintaining a selected temperature differential between the first fluid 38 entering the attenuation assembly and leaving the attenuation assembly, by controlling the first flow rate. Under certain processing conditions, a temperature differential between about 10° C. to about 85° C. produces acceptable results. A controller 64 is coupled to the fluid supply system 60 and fluid temperature control system 62, and may be used to regulate the average first fluid temperature and speed of the first fluid flow. By adjusting the first temperature and corresponding attenuation in certain regions, the EM waves of the slot antenna 16 may be manipulated to produce a more uniform plasma distribution in the processing chamber.

In use, is preferable to operate the fluid supply system 60 and the fluid temperature control system 62 for a period of time prior to each initiation of plasma. This step allows the first fluid 38 (and any additional fluids), as well as the attenuation assembly itself, to stabilize and achieve a desired steady-state temperature prior to being exposed to the heat generated by the plasma. If the plasma is initiated first, with the operation of the fluid supply system 60 and the fluid temperature control system 62 occurring second, this could result in undesirable extreme starting temperatures.

Figure 4:
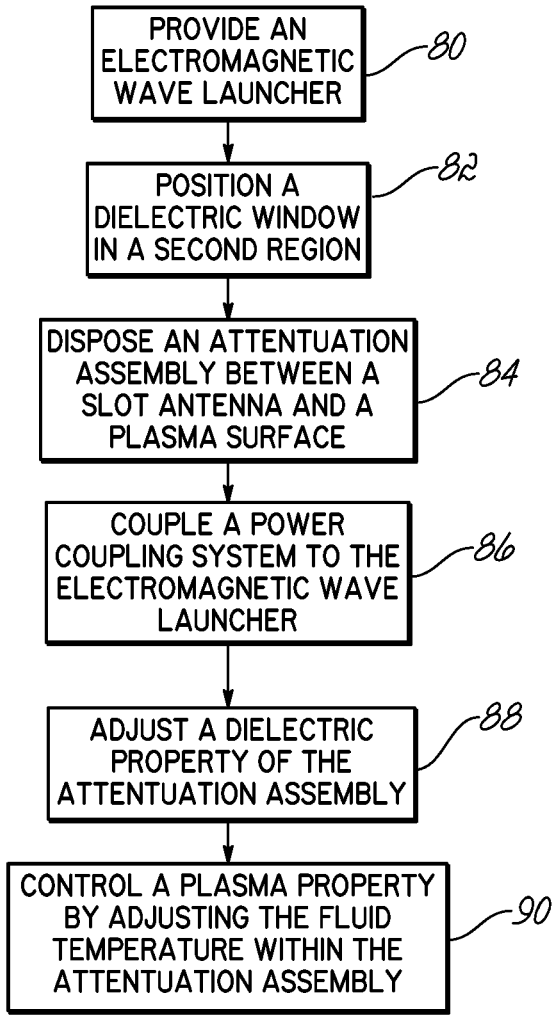
FIG. 4 is a flowchart depicting a method of controlling a plasma property.

The SWPS 10 described above may be used to perform a method of controlling a property of plasma, as shown by the flowchart in FIG. 4. In 80, the method includes providing an electromagnetic (EM) wave launcher configured to couple EM energy in a desired EM wave mode to a plasma by generating a surface wave on a plasma surface 36 of the SWPS 10 adjacent the plasma. The EM wave launcher comprises a slot antenna 16 having a plurality of slots 18 formed therethrough configured to couple the EM energy from a first region 20 above the slot antenna 16 to a second region 22 below the slot antenna 16. In 82, a dielectric window 24 is positioned in the second region 22, wherein the dielectric window 24 has a lower surface 34, and a plasma surface 36 (less than or equal to the surface area of the lower surface 34) that is adjacent to the generated plasma. In 84, the method includes providing an attenuation assembly between the slot antenna 16 and the plasma surface 36, wherein the attenuation assembly includes a first fluid channel 26 substantially aligned with a first arrangement of slots 30 in the plurality of slots 18 and configured to receive a first flow of a first fluid 38 at a first fluid temperature. In 86, a power coupling system 12 is coupled to the EM wave launcher and configured to provide the EM energy to the EM wave launcher for forming the plasma. In 88, the method includes adjusting a dielectric property of the attenuation assembly, and in 90, controlling a plasma property by adjustment of the first fluid temperature of the attenuation assembly.

The above method may be modified to control a uniformity of the plasma by providing a second fluid channel 28 formed within the attenuation assembly. The second fluid channel 28 is substantially aligned with a second arrangement of slots 32 in the plurality of slots 18 and is configured to receive a second flow of a second fluid 44 at a second fluid temperature. The plasma uniformity is altered by adjusting the first fluid temperature, the second fluid temperature, or both.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A surface wave plasma source (SWPS), comprising:

an electromagnetic (EM) wave launcher configured to couple EM energy in a desired EM wave mode to a plasma by generating a surface wave on a plasma surface located adjacent said plasma, said EM wave launcher comprising a slot antenna having a plurality of slots formed therethrough configured to couple said EM energy from a first region above said slot antenna to a second region below said slot antenna;

a dielectric window positioned in said second region and having a lower surface of said dielectric window including said plasma surface;

an attenuation assembly disposed between said slot antenna and said plasma surface, wherein said attenuation assembly includes a first fluid channel substantially aligned with a first arrangement of slots in said plurality of slots and configured to receive a first flow of a first fluid at a first fluid temperature;

a fluid supply system coupled to said first fluid channel and configured to supply said first flow of said first fluid through said first fluid channel;

a fluid temperature control system configured to selectably add or remove heat from said first fluid; and a power coupling system coupled to said EM wave launcher and configured to provide said EM energy to said EM wave launcher for forming said plasma.

2. The surface wave plasma source of claim 1, wherein said attenuation assembly comprises a first portion, a second portion, a sealing channel, and a sealing member; wherein said first portion and said second portion are joined together and fluidically sealed by the cooperation of said sealing channel and said sealing member.

3. The surface wave plasma source of claim 1 wherein said fluid temperature control system includes an evaporative chiller.

4. The surface wave plasma source of claim 1 wherein said fluid temperature control system includes an air-cooled chiller.

5. The surface wave plasma source of claim 1 wherein said fluid temperature control system includes a resistive heating element.

6. The surface wave plasma source of claim 1 wherein said fluid supply system includes a variable speed pump.

7. The surface wave plasma source of claim 1, further comprising:

a controller electrically coupled to said fluid temperature control system and said fluid supply system, wherein said controller is configured to adjust a magnitude of said first fluid temperature and a speed of said first fluid flow.

8. The surface wave plasma source of claim 7, further including a sensor array configured to detect said magnitude of said first fluid temperature entering or exiting said attenuation assembly, and to detect said speed of said first fluid flow.

9. The surface wave plasma source of claim 8, wherein said controller is electrically coupled to said sensor array and configured to adjust said magnitude of said first fluid temperature and said speed of said first fluid flow, in response to data from said sensor array, to maintain a temperature differential of about 10° C. to about 85° C. between said first fluid entering and said first fluid exiting said attenuation assembly.

10. The surface wave plasma source of claim 8, wherein said controller is configured to adjust said magnitude of said first fluid temperature and said speed of said first fluid flow to maintain a selected attenuation level.

11. The surface wave plasma source of claim 1, further comprising:

a second fluid channel formed within said dielectric window, said second fluid channel substantially aligned with a second arrangement of slots in said plurality of slots and configured to receive a second flow of a second fluid at a second fluid temperature.

12. The surface wave plasma source of claim 1, wherein the attenuation assembly is confined within said dielectric window.

13. A surface wave plasma source (SWPS), comprising:

an electromagnetic (EM) wave launcher configured to couple EM energy in a desired EM wave mode to a plasma by generating a surface wave on a plasma surface located adjacent said plasma, said EM wave launcher comprising a slot antenna having a plurality of slots formed therethrough configured to couple said EM energy from a first region above said slot antenna to a second region below said slot antenna;

a dielectric window positioned in said second region and having a lower surface of said dielectric window including said plasma surface;

an attenuation assembly disposed between said slot antenna and said plasma surface, wherein said attenuation assembly includes a first fluid channel substantially aligned with a first arrangement of slots in said plurality of slots and configured to receive a first flow of a first fluid at a first fluid temperature, wherein said first fluid channel includes an EM-transparent duct disposed therein, and configured to form a fluid-tight barrier between said first fluid channel and said first fluid; and a power coupling system coupled to said EM wave launcher and configured to provide said EM energy to said EM wave launcher for forming said plasma.

14. The surface wave plasma source of claim 13, further comprising:

a fluid supply system coupled to said first fluid channel and configured to supply said first flow of said first fluid through said first fluid channel; and a fluid temperature control system configured to selectably add or remove heat from said first fluid.

15. The surface wave plasma source of claim 14, further comprising:

a sensor array configured to detect a magnitude of said first fluid temperature entering or exiting said attenuation assembly, and to detect a speed of said first fluid flow; and a controller electrically coupled to said fluid temperature control system, said fluid supply system, and said sensor array and configured to adjust said magnitude of said first fluid temperature and said speed of said first fluid flow, in response to data from said sensor array, to maintain a temperature differential of about 10° C. to about 85° C. between said first fluid entering and said first fluid exiting said attenuation assembly.

16. A method for controlling plasma properties in a surface wave plasma source (SWPS), comprising:

providing an electromagnetic (EM) wave launcher configured to couple EM energy in a desired EM wave mode to a plasma by generating a surface wave on a plasma surface located adjacent said plasma, said EM wave launcher comprising a slot antenna having a plurality of slots formed therethrough configured to couple said EM energy from a first region above said slot antenna to a second region below said slot antenna;

positioning a dielectric window in said second region and having a lower surface of said dielectric window including said plasma surface, disposing an attenuation assembly between said slot antenna and said plasma surface, wherein said attenuation assembly includes a first fluid channel substantially aligned with a first arrangement of slots in said plurality of slots and configured to receive a first flow of a first fluid at a first fluid temperature;

coupling a power coupling system to said EM wave launcher configured to provide said EM energy to said EM wave launcher for forming said plasma;

controlling a plasma property of said plasma by adjusting a dielectric property of said attenuation assembly, wherein said adjusting is of said first fluid temperature;

providing a fluid supply system coupled to said first fluid channel and configured to supply said first flow of said first fluid through said first fluid channel; a fluid temperature control system configured to selectably add or remove heat from said first fluid; a controller electrically coupled to said fluid temperature control system and said fluid supply system and configured to adjust a magnitude of said first fluid temperature and a speed of said first fluid flow; and a sensor array configured to detect said magnitude of said first fluid temperature entering or exiting said attenuation assembly and to detect said speed of said first fluid flow; and using said controller, said sensor array, said fluid temperature control system, and said fluid supply system to adjust a magnitude of said first fluid temperature and a speed of said first fluid flow to maintain a fluid metric during semiconductor processing.

17. The method of claim 16 wherein maintaining said fluid metric includes sustaining a selected average first fluid temperature throughout a volume of said first fluid confined within said attenuation assembly.

18. The method of claim 16 wherein maintaining said fluid metric includes sustaining a temperature differential of about 10° C. to about 85° C. between said first fluid entering and said first fluid exiting said attenuation assembly.

19. The method of claim 16, wherein maintaining said fluid metric includes maintaining a selected attenuation level.

20. The method of claim 16, further comprising:

controlling a uniformity of said plasma by providing a second fluid channel formed within said attenuation assembly, said second fluid channel being substantially aligned with a second arrangement of slots in said plurality of slots and configured to receive a second flow of a second fluid at a second fluid temperature, and altering said uniformity by adjusting said first fluid temperature, said second fluid temperature, or both.

* * * * *